United States Patent [19]

Goldfarb et al.

[11] 4,162,069

[45] Jul. 24, 1979

[54] ACTION SKILL GAME

[75] Inventors: Adolph E. Goldfarb, Tarzana; Delmar K. Everitt, Woodland Hills, both of Calif.

[73] Assignee: Adolph E. Goldfarb, Northridge, Calif.

[21] Appl. No.: 876,420

[22] Filed: Feb. 9, 1978

[51] Int. Cl.[2] ..... A63F 9/00

[52] U.S. Cl. ..... 273/1 R

[58] Field of Search ..... 273/1 R, 1 E, 1 M

[56] References Cited

U.S. PATENT DOCUMENTS

| | | | |
|---|---|---|---|
| 3,494,617 | 2/1970 | Glass et al. | 273/1 R |
| 3,899,169 | 8/1975 | Rhodes et al. | 273/1 R |
| 3,908,989 | 9/1975 | Meyer | 273/1 R |

*Primary Examiner*—Paul E. Shapiro

*Attorney, Agent, or Firm*—Robert M. Ashen; Robert J. Schaap

[57] ABSTRACT

A slow-moving object, such as a toy vehicle car, is movable forwardly along a roadway which is extended in one direction. The roadway is extended by laying successive planks on a pair of rails. The planks are present in sufficient number to extend between opposite ends of the rails. The edges of the planks are encoded by having irregular edges. The irregular edges of only one or a few of the planks will conform to the irregular edge of the then forwardmost end of the roadway. When properly matched, the planks form a generally continuous roadway for the slowly moving vehicle. The user must properly position planks in place in advance of the arrival of the vehicle to provide a roadway for the vehicle to travel upon. If the vehicle arrives at the forwardmost end of the roadway, the movement of the vehicle may be interrupted or the vehicle may fall through the roadway.

The toy vehicle is provided with a mechanism for ejecting an object representing a passenger in the event that one of the players attempts to stop the movement of the vehicle. In addition, the toy vehicle is provided on its underside with a position detector which will engage one of the planks which has been improperly matched and push the same along the rails of the bridge-like structure so that the vehicle will fall through the bridge-like structure.

37 Claims, 8 Drawing Figures

V
80
70
76
130
96
89
86
102
88
122
120
84
28
40
42
24
30
100
74
98
94
93
92
72
90
82
16
12

ACTION SKILL GAME

BACKGROUND OF THE INVENTION

1. Purpose of the Invention

This invention provides in general certain new and useful improvements in action skill games, and, more particularly, an action skill game in which a player must assemble in predetermined relationship a plurality of elements to thereby create a path or readway in front of a slow-moving object before the object can reach the end of that roadway.

2. Brief Description of the Prior Art

There have been made skill action games known in the prior art in which a player is required to locate a plurality of objects in their required positions within a predetermined time interval. One such action skill game known in the prior art comprises a playing game board having a plurality of recesses therein and in which a plurality of objects have shapes which conform to only one or a few of the recesses. Thus, the player must select each object and attempt to place each object in the proper recess shaped and sized for such object. All objects must be placed in the proper recesses within a predetermined time limit. Generally, the predetermined time limit is controlled by a spring motor located within the game board.

After the predetermined time limit or interval has passed, a certain action will occur, as for example, the pushing of the objects out of the recesses. Thus, if the action, as for example, the pushing of the objects out of the recesses, occurs before the player has inserted all of the objects in their proper recesses, then the player will lose the game.

Other forms of action skill toys utilize a similar principle and in which the objects may fall through the recesses after the predetermined time interval. In one such game, the player is required to insert certain pegs with numbered indicia thereon into proper recesses in the game board. After the predetermined time interval, all of the pegs will fall through the game board. Thus, if the player has not inserted all of the pegs within the predetermined time limit, that player will also lose the game.

Another prior art game of skill and action known as "Demolition Derby" employs a movable vehicle, such as a miniature self-propelled car moving on a playing surface with a plurality of obstacles on the playing surface. In this case, the toy vehicle is released from a confined area, referred to as a "car pit", when a gate is opened on the pit. The player of the game attempts to tilt the game board so as to maneuver the toy vehicle. The player must attempt to knock down all upstanding objects or obstacles on the game board and maneuver the car back into the pit before the gate closes. The opening and closing of the gate is operated by a time control mechanism such that the player must overcome all obstacles, namely, knocking down all upstanding objects, and return the car to the pit before the gate closes.

OBJECTS OF THE INVENTION

It is, therefore, a primary object of the present invention to provide an action skill game in which a player attempts to properly position planks on an open support structure and complete a roadway in advance of a moving object.

It is another object of the present invention to provide an action skill game in which the planks are encoded so that they must be positioned on the support structure in a preestablished encoded relationship.

It is yet another object of the present invention to provide an action skill game of the type stated in which each of the planks have irregular edges that can be matched with only one or a few of the other planks such that the player must properly select each of the planks and place them in their proper position with respect to the next adjacent plank.

It is a further object of the present invention to provide an action skill game of the type stated in which a movable vehicle slowly moves across a roadway formed by the planks and the open support structure is a bridge-like structure.

It is yet a further object of the present invention to provide an action skill game of the type stated in which an action effect occurs if the vehicle reaches the end of an incompleted roadway and in which the toy vehicle is provided with means to eject a passenger-representing object if the player attempts to stop movement of the vehicle.

It is also an object of the present invention to provide an action skill game of the type stated in which the vehicle is provided with a detector to determine if any plank has been placed in a position where it does not properly match the preceding or adjacent plank.

It is an additional object of the present invention to provide an action skill game of the type stated in which players of various ages and levels of skill can play the game.

It is another salient object of the present invention to provide an action skill game of the type stated which can be manufactured at a relatively low cost and which is relatively durable in its construction.

It is also an object of the present invention to provide a method of playing an action skill game in which a player attempts to assemble a plurality of planks in advance of an advancing toy vehicle.

With the above and other objects in view, our invention resides in the novel features of form, construction, arrangement and combination of parts presently described and pointed out in the claims.

SUMMARY OF THE DISCLOSURE

An action skill game apparatus in which a player attempts to position a plurality of planks in proper relationship on an open support structure in order to complete a roadway in advance of a moving object, such as a moving vehicle. If the vehicle arrives at the forwardmost end of the roadway, that is, where a plank has not yet been properly positioned, an action effect will occur. That action effect may be an interruption of the movement of the vehicle, as for example, the vehicle falling through the open support structure at the end of the incompleted roadway. The moving vehicle or other object thus functions as a moving timer and is preferably, though not necessarily, self-propelled.

The open support structure may adopt the form of a pair of spaced apart generally parallel rails which may be disposed on a support surface and with an open space therebetween and the planks are positioned on the rails. In a preferred embodiment, the rails form part of a bridge-like structure which extends between a pair of spaced apart upstanding supports. The planks have an upper surface and an edge on each of the opposite sides thereof. Thus, the upper surfaces of the positioned planks, or at least portions of the upper surfaces of these planks, form the roadway for the vehicle. The planks are provided in a sufficient number to extend across the rails between the two upstanding supports and can be placed in proper relationship to form a continuous roadway for the moving vehicle from one support to the other. The open support structure could have a partially completed roadway where the player or players of the game are required to complete the roadway by properly positioning the planks.

The game apparatus of the present invention may be played in various modes of play. Thus, the various planks may be encoded, as for example by color or indicia on the upper surface, so that the players may be required to place the planks on the open support structure in a proper order in accordance with a predetermined encoded relationship. The various means of encoding the planks are hereinafter described in more tail. Where the planks are to be positioned in accordance with an encoded relationship, it is preferable to use a vehicle or other object which moves at a slow rate of speed.

In a preferred embodiment of the invention, each plank has an irregular edge where it is engageable with the next adjacent plank. Moreover, the irregular edge on each plank mates with the irregular edge of at least one plank, but not more than a few of the other planks, so that when two planks are properly matched, they form a generally continuous extension of the roadway. Moreover, the planks can be orientable in upside-down positions such that either one flat face of the plank is upright or the opposite flat face is upright. Thus, it is possible to orient the planks in any of four different positions in an attempt to match the irregular edge of a plank on the bridge-like structure. This construction increases the skill necessary to play the game.

The planks each have an irregular edge as aforesaid in a preferred embodiment of the invention. However, it should be understood that the irregular edge is only one form of encoding which may be used to assemble the planks in a proper relationship. Other forms of encoding the planks in order for the player to assemble the planks in a proper relationship to one another may be employed. Thus, for example, the planks may have different colors, e.g. red, green, blue, etc., so that the planks must be assembled in a proper color encoded relationship, as for example, red, green and blue in that order. Otherwise, the players may be required to assemble the planks in a predetermined order of a certain number of red, a certain number of blue, etc. In addition, the encoding of the planks may taken the form of indicia on the planks such as numbers so that the player may be required to assemble the planks in a proper numbered relationship, e.g. 1, 2, 3, 4, etc., or to spell a word or the like.

The planks may also be provided with flanges on each of the opposite sides thereof and at the ends of each of the opposite edges. Preferably the flanges extend above and below the upper surface of the plank. In this way, the flanges serve as retaining walls for the vehicle so that the vehicle does not fall from the sides of the roadway and can only fall through an incompleted end of the roadway.

In order to use the game apparatus, all or a number of the planks are removed from the supporting rails. At this point, the vehicle is started and preferably the vehicle is slow moving. After starting the movement of the vehicle, a user or "player" attempts to place all of the planks on the rails and complete the roadway. If the player does not properly lay the planks in a conforming or proper relationship on the rails before the vehicle reaches the portion of the roadway thus formed, the movement of the vehicle will be interrupted. In this case, the conforming relationship of the planks would depend on the encoding system employed. Thus, planks positioned in a proper relationship according to a color code or the like are conforming. In addition, planks positioned so that the edges of the planks mate are also conforming, etc. In this case, the interrupted movement of the vehicle results from the vehicle falling through or partially through the open support structure. In the case of a bridge-like structure, the vehicle will fall completely through the rails beyond the portion of the completed roadway and into a trough therebeneath. The number of planks placed on the rails by the player may thereupon determine the score of the player. Otherwise, the player may achieve a score or otherwise win the game by completing the roadway. Where a bridge-like support structure is used, the players may be required to properly position all planks from one support to the other before the arrival of the vehicle.

In one embodiment of the invention, the planks may all have the same size and shape or similar sizes and shapes. The players may be required to place the planks on the rails in advance of a more rapidly moving vehicle. In this mode, the planks could be provided with generally regular edges so that one plank will match the edge of a next adjacent plank. In this embodiment of the invention, the players would be required to use a high degree of rapid movement and coordination.

As used herein, the term "interrupted" in reference to the movement of the vehicle or other object is used in a broad sense and refers to the movement of the vehicle being stopped on the roadway before reaching the end of a completed roadway, e.g. the second upstanding support of the support structure. Thus, the movement of the vehicle could be interrupted by a player stopping the movement of the vehicle with his hand or otherwise. In addition, the movement of the vehicle could be interrupted by falling through or partially through the open support structure before the roadway is completed. The "interrupted" movement of the vehicle could also include some action effect such as the closing or opening of a switch, or sound and/or visual effects or the like.

When the planks are positioned on the rails in proper relationship in accordance with the predetermined coding, they will form a generally continuous upper surface which creates the roadway. As indicated, in a preferred embodiment of the invention, the planks have irregular edges which mate with the irregular edge of the next adjacent plank in a truly continuous manner. However, it is not necessary for the edges of two adjacent planks to have complete mating edges when placed in proper relationship in accordance with the preestablished encoding. Thus, the planks could have only portions of the edges which are in properly mated relationship. In like manner, it is not necessary for the opposed edges of two adjacent planks to be disposed in a physical mating relationship to provide a generally continuous surface. Thus, the planks could be positioned close enough to each other in a proper encoded relationship which is sufficient to form a path to receive and support, as for example, the wheels of a vehicle or other object during movement thereof. Accordingly, the edges could mate in only a portion thereof so that they form a generally continuous upper supporting surface. As used herein, the term "generally continuous", therefore, shall mean that two adjacent planks shall have at least only portions of the adjacent edges which are properly matched, but sufficiently close to form a path for supporting a moving object. In an embodiment of the invention where the planks are to be mated, that is with opposed edges in physical contact with each other, it is necessary to only have portions of the mating edges in contact with each other and which mating portions are sufficient to support the moving vehicle or other moving object. Thus, the mating portions form a generally continuous surface or roadway. Thus, it is not necessary for the entire edge of two adjacent planks to properly mate. In essence, the planks when assembled in a proper relationship to form a path for the vehicle or other object present a generally continuous surface or roadway, if they support the movement of the vehicle without causing an interrupted movement of the vehicle as defined above.

The term "rail" as used herein is not intended to imply a rail of the type used in railroads, although the rails of the invention could adopt that form. Thus, the term "rail" is used in the broad sense to mean any bar or other elongate element and where any two of such elongate elements in parallel spaced apart relationship are sufficient to hold and support one or more planks disposed thereon. The term "plank" as used herein is also used in the broad sense to mean any member which presents an upper surface capable of supporting a moving object and is preferably, though not necessarily, flat or relatively flat. In addition, the term "plank" is not intended to mean a board of wood but a member of the type stated which could be formed of generally any sufficiently ridig material. The term "roadway" is also used in a broad sense to mean a pathway in any form to support a moving object.

When the vehicle does reach the second support or travels over a completed roadway, it will trigger a mechanism to raise a flag or other indicia showing that the player achieved a score or otherwise depicting a winner of the game. Moreover, this trigger mechanism is operable to also stop the movement of the vehicle.

The vehicle or other moving object is provided with a motor, preferably a spring wind-up motor, and which may be geared down to provide slow movement thereof. Moreover, the vehicle may be provided with one object simulating a passenger and an automatic eject mechanism with an ejector contact on the front end of the vehicle. In this way, if a player attempts to stop the movement of the vehicle with his hand while assembling the planks, the ejector contact on the front end of the vehicle forming part of the automatic eject mechanism will cause the ejection of the object simulating a passenger. In addition, the vehicle is provided with a so-called "floating" detector pin which engages the upper surface of the roadway and is designed to detect improper positioning of the planks. In this case, if one plank does not properly conform to the next adjacent plank, a space will exist therebetween, at least in the region of the detector pin, and the pin will drop into the space, thereby pushing the preceding planks ahead. As the planks are moved, a void in the roadway will be created and the vehicle will thereupon fall through the void.

The game apparatus of the present invention may be used competitively by one or more competing players. Thus, a number of players could take turns in attempting to completely build or assemble a roadway by laying planks in advance of the moving vehicle. The player could achieve a score in accordance with the number of planks placed on the support structure in advance of the moving vehicle, or otherwise, the player laying the largest number of planks in advance of the moving vehicle could be the only one to achieve a score. The game apparatus could also be played in a manner where all of the planks are removed from the roadway and the players are required to assemble to build a roadway from one end to the other of the open support structure to achieve a score or win a game. In like manner, one player may compete against himself by trying to increase his score on subsequent turns attempting to complete the roadway. Thus, the game apparatus is competitive in the sense that it can be played by two or more competing players or by one player who competes against himself.

The game apparatus could also be played with a handicap designed for one or more players. Thus, younger of less skilled players may remove a lesser number of planks than a player who is older or more skilled and then attempt to reassemble those planks in advance of a moving vehicle.

BRIEF DESCRIPTION OF THE DRAWINGS

Figure 1:
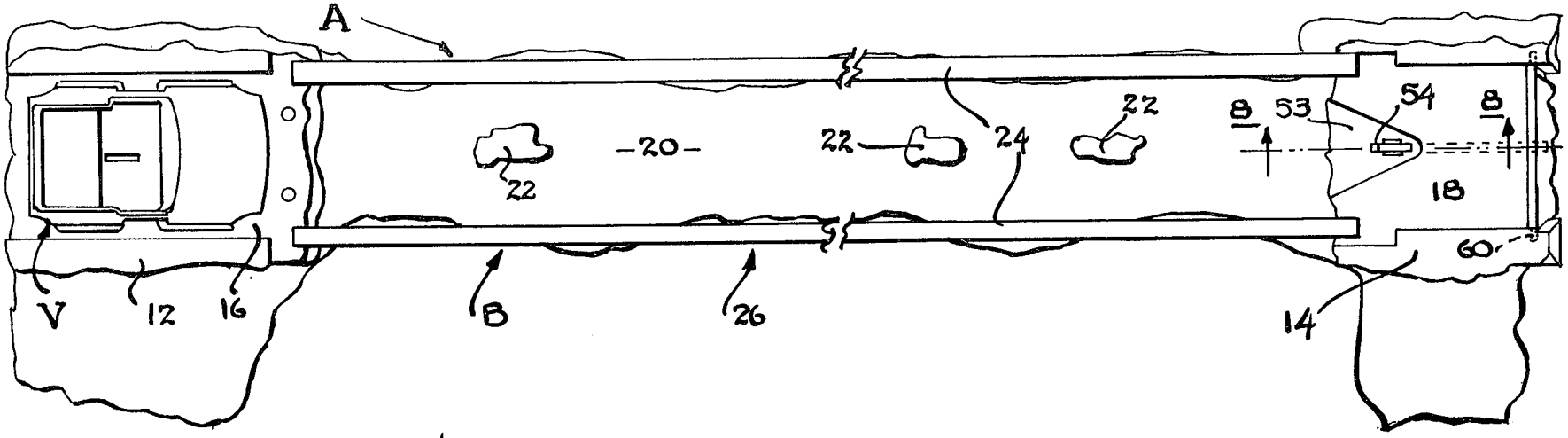
Figure 2:
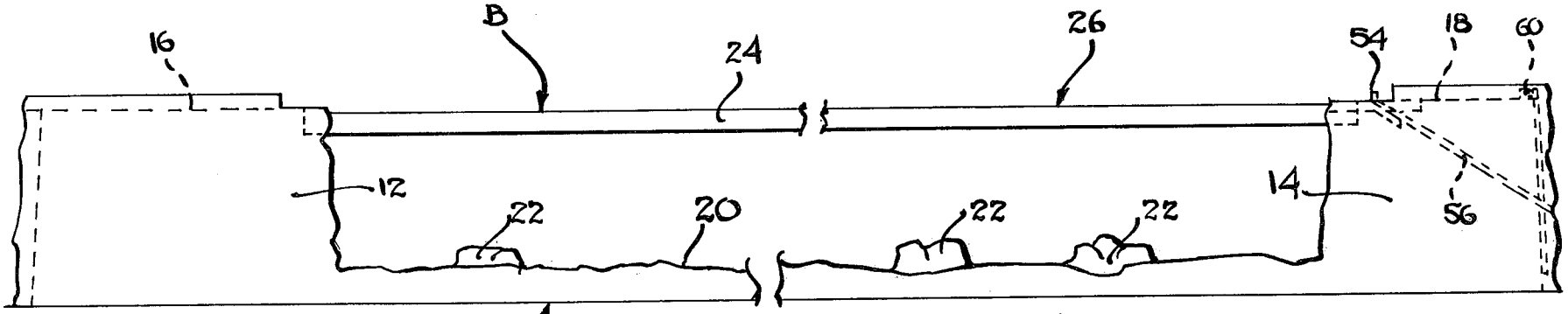
Figure 4:
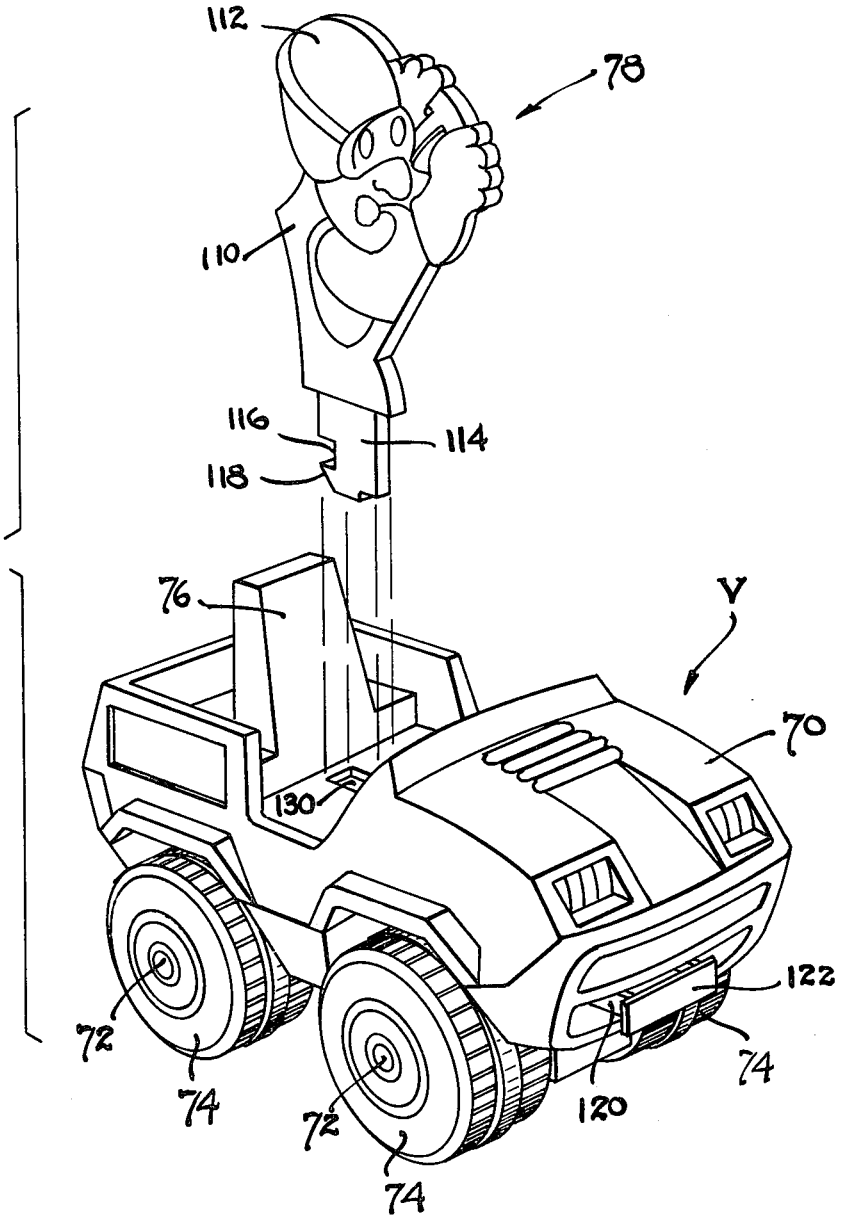
Figure 3:
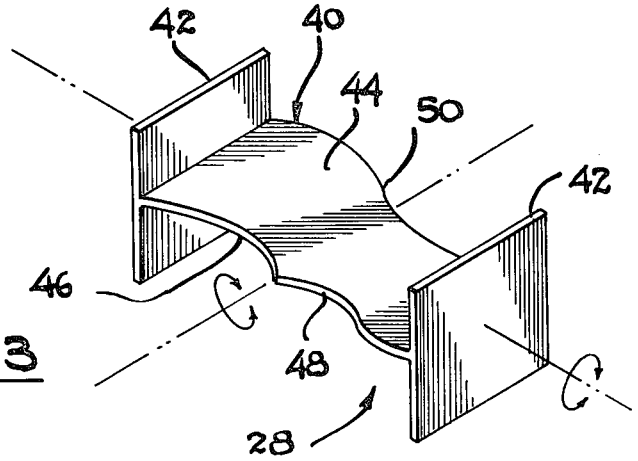
Figure 5:
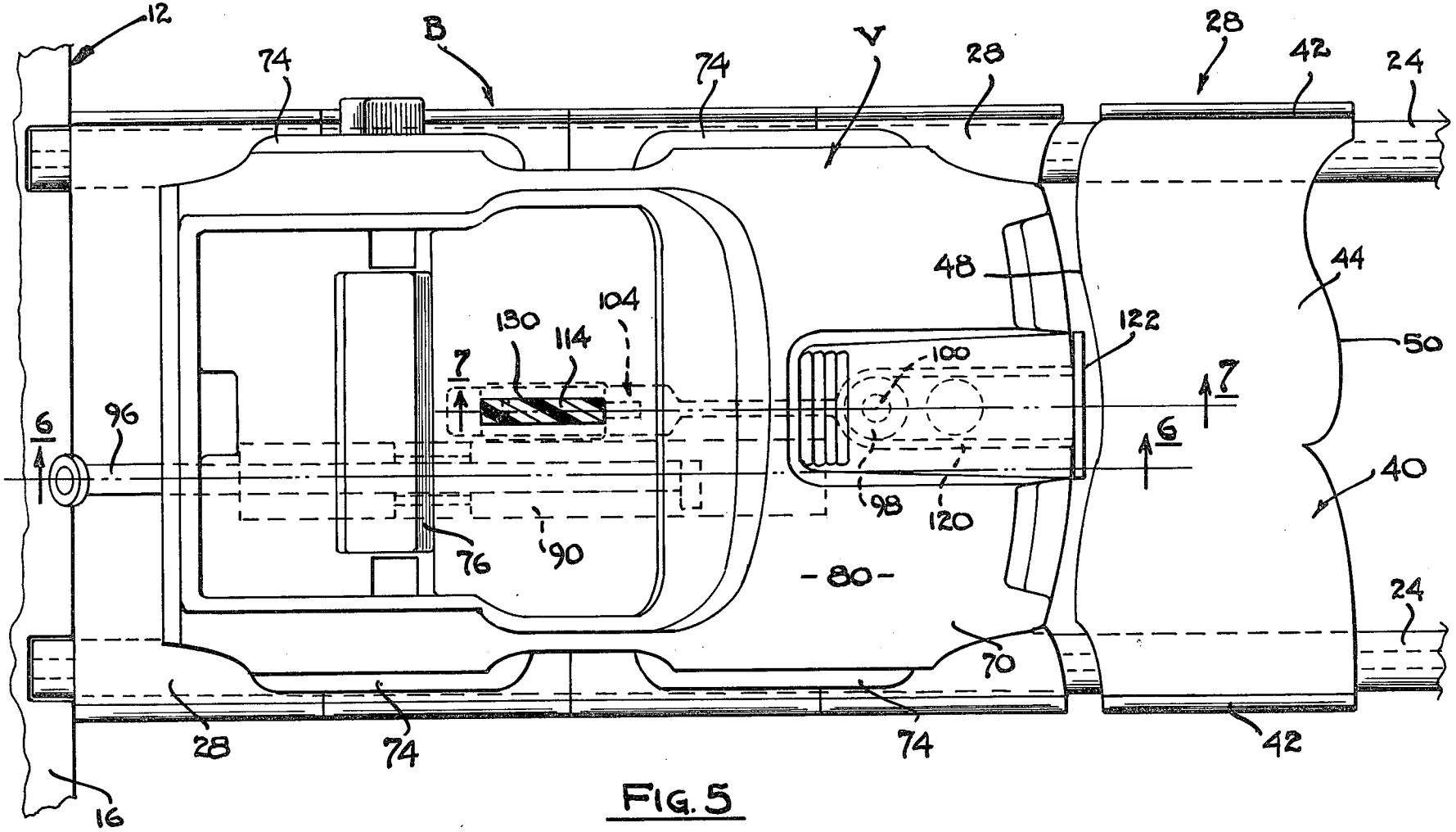
Figure 6:
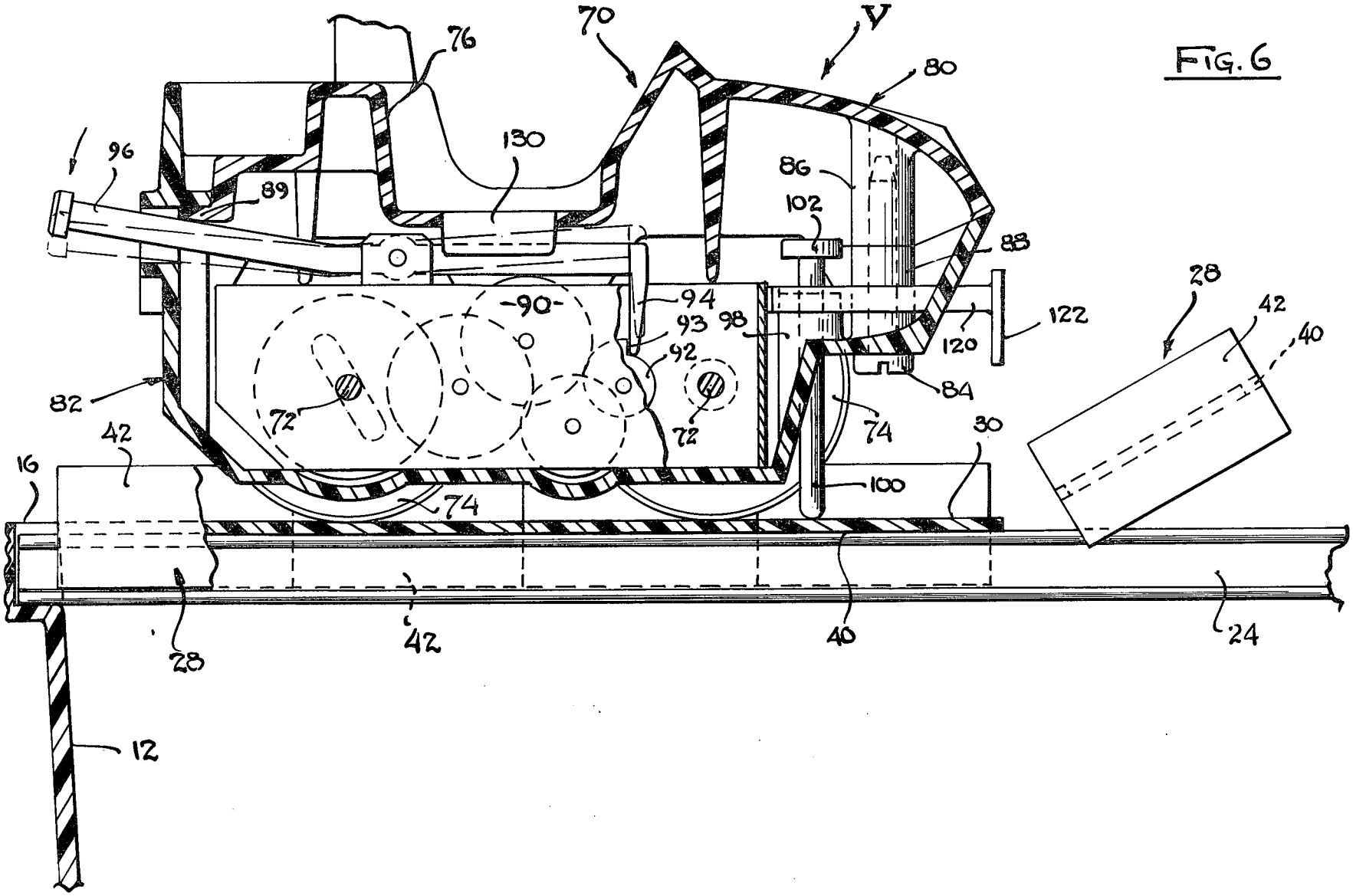
Figure 7:
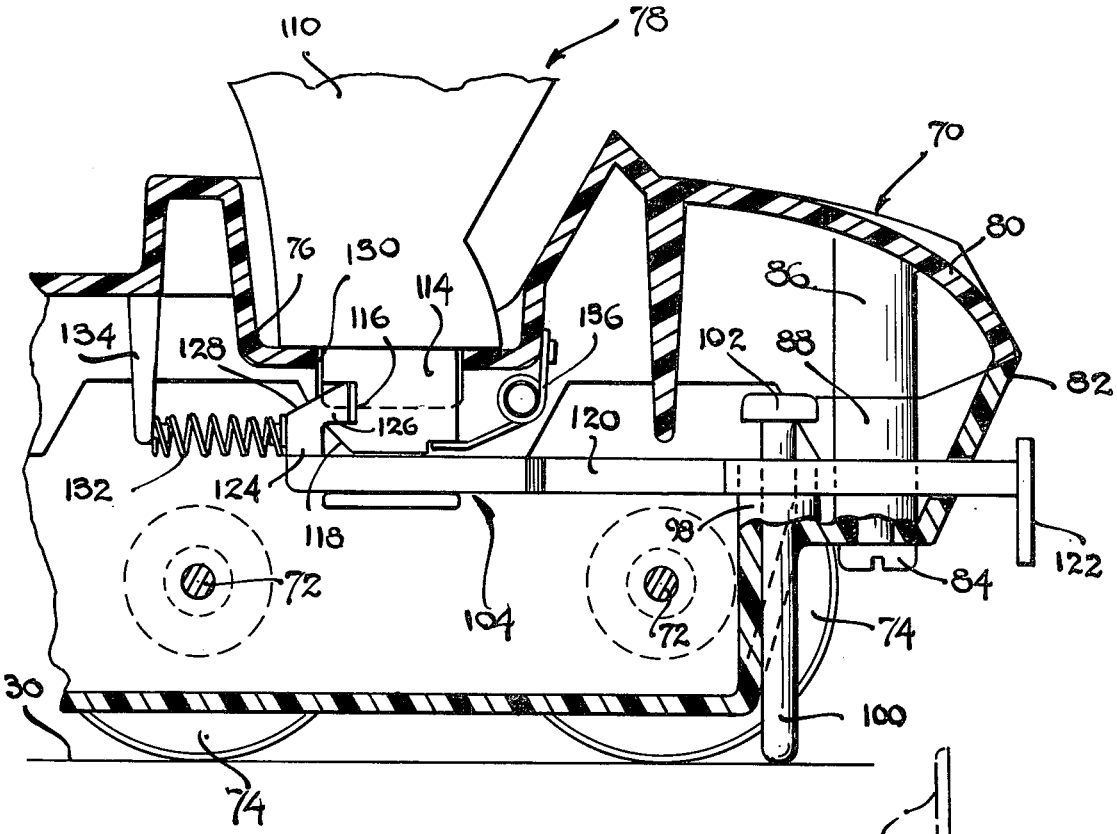
Figure 8:
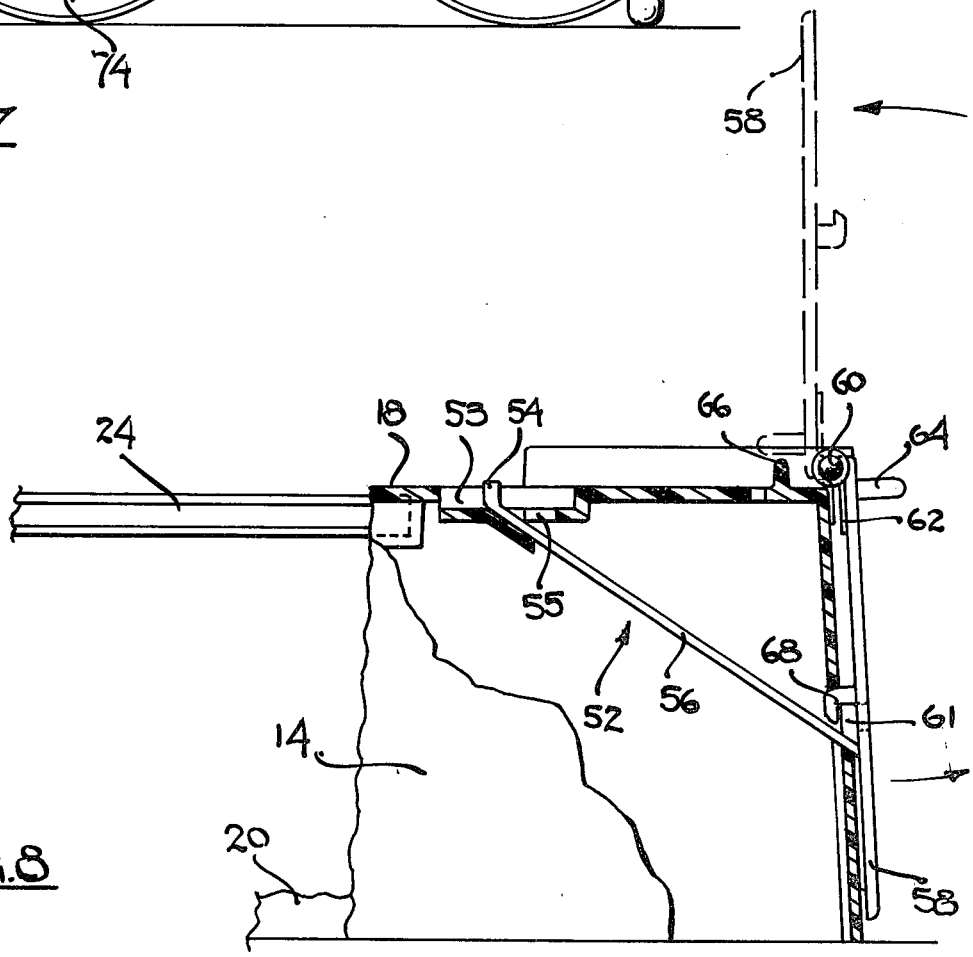

Having thus described the invention in general terms, reference will now be made to the accompanying drawings in which:

FIG. 1 is a top plan view of a bridge-like structure forming part of the action skill game of the present invention and which is constructed in accordance with and embodies the present invention, FIG. 2 is a side elevational view of the bridge-like structure of FIG 1;

FIG. 3 is a perspective view of one of the planks used in the assembly of the bridge-like structure of the present invention;

FIG. 4 is an exploded perspective view showing the toy vehicle forming part of the action skill game of the present invention with an object being ejected therefrom;

FIG. 5 is a fragmentary top plan view of the vehicle of FIG. 4 on a portion of the roadway being assembled on the bridge-like structure;

FIG. 6 is a vertical sectional view taken along line 6--6 of FIG. 5 and showing a portion of the drive mechanism forming part of the toy vehicle;

FIG. 7 is a fragmentary vertical sectional view taken along line 7—7 of FIG. 5 and showing a portion of an object eject mechanism forming part of the toy vehicle; and FIG. 8 is a fragmentary side elevational view, partially in section, and showing a shiftable indicator mechanism forming part of the bridge-like structure in accordance with the present invention.

DETAILED DESCRIPTION OF THE PREFERRED EMBODIMENTS

Referring now in more detail and by reference characters to the drawings, A designates a skill action toy game comprising a bridge-like structure B and a movable toy object such as a toy vehicle V. The bridge-like structure is generally comprised of a base section 10 having a pair of longitudinally spaced apart upstanding supports 12 and 14 in the manner as illustrated in FIGS. 1 and 2 of the drawings. The upstanding supports 12 and 14 each are provided with relatively flat top surfaces 16 and 18, respectively.

The base section 10 is provided with a floor section 20 which represents a canyon floor in accordance with this embodiment of the present invention. For this purpose, a plurality of upstanding objects 22, representing rocks, etc., may be formed on the floor section 20. The two upstanding supports 12 and 14 are representative of mountains so that the area therebetween may represent a canyon.

Extending between the two upstanding supports 12 and 14 are a pair of spaced apart longitudinally extending rails 24 which form part of the bridge-like structure B. The rails 24 are embedded in or otherwise rigidly secured to the upstanding supports 12 and 14. Moreover, the upper surface of the rails 24 are essentially contiguous with the flat surfaces 16 and 18, respectively, of the upstanding supports 12 and 14.

While the two upstanding supports 12 and 14 represent mounds or mountains with the floor section 20 representing a canyon extending therebetween, any characterization could be provided. For example, the upstanding supports could be configured as structures of elements representing steel beams and the floor section 20 could represent a body of water. However, in accordance with the present invention, it is important for the rails 24 for form a bridge-like structure extending between the two upstanding supports 12 and 14.

The bridge-like structure B is also formed by a plurality of transversely extending planks 28 which span the two rails 24. These planks 28, when properly assembled in a mating relationship as hereinafter described in more detail, will form an upper roadway 30 which is continuous with the flat surfaces 16 and 18 on the upstanding supports 12 and 14. In this respect, a sufficient number of planks 28 are provided in order to form a complete and generally contiguous roadway 30 between the flat surfaces 16 and 18.

One of the planks which extends across the rails 24 is more fully illustrated in FIG. 3 of the drawings and comprises a flat plate 40 having a pair of vertically disposed end flanges 42 at each of the opposite transverse ends thereof. In this case, the flanges 42 serve as retaining elements and are designed to extend along the exterior surfaces of each of the transversely spaced apart rails 24.

The flat plate 40 is provided with a first flat surface 44 and a second opposite flat surface 46, both extending between the flanges 42. The plate 40 also includes a first irregular edge 48 on one side thereof extending between the two flanges 42 and a second irregular edge 50 on the other side thereof and also extending between the two flanges 42. The two flanges 42 extend above and below the flat plate 40 so that the plank 28 may be located on the rails 24 with either of the two flat surfaces 44 or 46 of the flat plate 40 presented upwardly. Thus, the plank 28 is designed so that it may be placed upon the rails 24 with either the flat surface 44, or otherwise with the flat surface 46, of the flat plate 40 presented upwardly.

Each of the planks 28 are of a similar size so that when located on the rails they will form a generally continuous upper surface or roadway for a vehicle. Moreover the irregular edge 48 is designed so that it will mate with a similar edge of another plank and, in like manner, the irregular edge 50 is designed so that it will mate with a mating edge of another plank. The irregular edges are designed so that the edge on one plate will fit within a corresponding edge of another plate, much in the same manner as two pieces of a puzzle fit together. Moreover, in the preferred aspect of the invention, one edge will match only one corresponding edge of another piece. However, the invention could be designed so that one edge of a plank could match a few corresponding edges of other planks in order to reduce the skill necessary to play the game.

In the preferred embodiment of the invention, the two planks can be used with either side up, as indicated previously. Moreover, due to the fact that each link will have a different irregular edge, there are four possible orientations for each plank. In this way, the player must very carefully select each plank and attempt to match one of the edges with respect to the last plank then assembled across the rails. The player must attempt to determine if either of the irregular edges of one of the planks to be used will match the irregular edge of the last plank on the bridge-like structure in either orientation, that is, with either of the flat surfaces presented upwardly. Accordingly, the players must use some degree of perception and skill and operate fairly quickly in order to assemble the bridge-like structure in advance of a moving vehicle V, the latter of which is described hereinafter in more detail. Nevertheless, the planks could be designed so that only one flat surface can be presented upwardly so that only two orientations of the plank are possible.

The use of the irregular edges on the planks is only one means of encoding the planks so that they can be assembled in a proper relationship, that is, so that the irregular edge of one plank fits the irregular edge of the next adjacent plank. In this way, the planks, when placed in a proper relationship, will form a generally contiguous upper surface thereby forming part of a roadway. Other means of encoding the planks may employ color combinations. Thus, some of the planks could have a blue color and other of the planks could have a white color with still other of the planks having a yellow color. Thus, the player of the game may be required to place the planks on the bridge-like structure in a proper color encoded relationship, as for example, in blue, white and yellow, and in that order.

Another form of encoding the planks may rely upon the use of indicia on the tops of the planks. Thus, for example, the planks may be numbered with a numerical coding, e.g. 1, 2, 3, etc. In this way, the player of the game will be required to assemble the planks on the bridge-like structure in the proper numerical relationship, as for example, 1, 2, 3, etc. In these latter embodiments, it may be desirable for the planks to have regular edges, for example, generally straight edges. Thus, the planks are not properly oriented by means of their irregular edges, but by means of the color encoding, or otherwise the indicia encoding.

In order to play the game, a certain number or all of the planks are removed from the supporting rails 24. The moving vehicle V is then located on the flat surface 16 of the upstanding support 12. In this respect, the flat surfaces 16 and 18 will form a continuation of the roadway 30 which is to be formed. The player will then start the movement of the vehicle which is generally a self-propelled vehicle and attempt to assemble the planks 28 on the rails 24 in advance of the arrival of the moving vehicle. In one aspect of the invention, the score of the players will be determined by the number of planks properly assembled before the arrival of the vehicle.

In another mode of play, the players can remove only so many of the planks from the right-hand end of the roadway in accordance with their level of skill. Thus, a younger player would remove less planks than an older and more skilled person. Thereafter, the player starts the movement of the vehicle and attempts to assemble the remaining planks across the rails in their proper position and to complete the roadway 30 to the second upstanding support 14 prior to the arrival of the vehicle. Again, if the player does not properly assemble all of the planks prior to the arrival of the vehicle, the movement of the vehicle will be interrupted, e.g. it will fall through the roadway. In this case, the player attempting to assemble all of the planks will lose. It can be observed that in accordance with this mode of play, various players of differing skills can play the game in a competitive manner.

The second support 14 is provided with a flag actuating mechanism 52 which is located within the second upstanding support 14, as more fully illustrated in FIG. 8. The flag actuating mechanism 52 includes a trigger or plunger 54 located in a V-shaped recess 53 on the flat surface 18 of the support 14. The trigger 54 extends slightly upwardly through an aperture 55 formed in the recess 53. Moreover, the trigger 54 is connected through a lever 56 to a flag element 58. In this case, the flag elememt is hinged to the exterior of the upstanding support 14 through a hinge 60. The flag normally lies in its lower position, as illustrated in the solid lines of FIG. 8. When the vehicle V rides onto the surface 18 and over the trigger 54, it will push the trigger 54 downwardly and thereby shift the link 56 downwardly and to the right, reference being made to FIG. 8. The flag 58 will pivot from its lower position to its upper position, as indicated in the phantom lines of FIG. 8. The flag mechanism could be provided with any suitable indicia, as for example, "winner", to depict a winner of the game.

The right-hand end of the link 56 may be provided with a tab to engage the inwardly presented flat surface of the flag element 58, and enable the link 56 to push the flag 58 away from its flush position against the upstanding support 24. In addition, a torque spring 62 is connected around the hinge 60 and may have tabs engaging to the support 14 and to the flag 58 so that when the flag 58 is pushed away from the wall of the support 14, the spring 62 will cause the flag 58 to raise to its upright position. Furthermore, the flag 58 is provided with a projection 64 which engages a similar upstanding projection 66 on the flat surface 18 of the support 14 to limit the upward movement of the flag. If desired, the flag 58 may also be provided with a hook 68 which is capable of extending into a recess or aperture in the support which also receives the outer end of the link 56.

The various components forming part of the bridge-like structure and those components forming part of the vehicle V as hereinafter described which comprise the apparatus of the present invention can be formed of a number of known plastic materials. Thus, for example, these plastic materials may include polyethylene, polystyrene, polybutadiene, various vinylidene copolymers and the like. These components may be formed in a number of known plastic molding operations, as for example, blow-molding, thermo-forming, injection molding, or the like. In addition, for purposes of increased strength and durablility, many of the components could be formed of reinforced plastic materials including, for example, fiberglas, boron, carbon and other fobers amd grown crystal whiskers incorporated in a suitable matrix, such as an eposy resin. Notwithstanding, many of the components of the apparatus could be formed of other known structural materials, such as metals, etc.

The vehicle V which is used in this embodiment of the present invention is representative of a toy car, more fully illustrated in FIGS. 3–6 of the drawings. As indicated previously, while the object is a vehicle V representative of a car, any form of moving object may be employed. In this respect, the moving object could represent a boat, or a walking man or animal or any other object which is capable of moving slowly across the roadway 30. In this case, the vehicle V comprises an outer body 70 having front an rear axles 72 with wheels 74 mounted thereon. Moreover, the vehicle is equipped with a seat 76 having an element 78 representative of a passenger or driver located within the seat.

The vehicle body 70 is constructed of two sheels including an upper shell 80 and a lower shell 82 generally formed of a molded plastic material. Moreover, the two shells are designed so that they can be interfitted together and retained by means of one simple fastener, such as a screw 84. The screw 84 extends between and is secured within a depending projection 86 on the upper shell and an upwardly struck projection 88 on the lower shell, both of which are located near the front end of the vehicle V. A snap-fitting locking tab 89 located at the rear of the two shells locks them together when the two shells are secured by the fastener.

Included within the body 70 of the vehicle V is a generally conventional spring wind-up motor 90 which includes a gear reduction mechanism in order to permit the vehicle to move at a relatively slow speed. Moreover, the spring wind-up motor 90 is operatively connected to the rear axle 72 in order to drive the rear wheels 74. The spring wind-up motor 90 is generally conventional in its construction, and in like manner the gear reduction mechanism is also conventional in its construction. However, the wind-up motor 90 does include a wheel 92 having a recess portion forming a shoulder 93. A shiftable locking pin 94 is also operatively connected to a motor actuating lever 96 for starting and stopping the motor. In this way, when the actuating lever 96 is pushed from its upper position, as illustrated in FIG. 4 of the drawings, to its lower position, as illustrated in the phantom lines of FIG. 4, the locking pin 94 will be released from its locking position with the shoulder 93 on the wheel 92. As this occurs, the motor 90 is then free to operate and cause rotation of the axle 72 and the rear wheels 74. In like manner, when the plunger 96 is pushed to its upper position, then the operation of the motor 90 will stop.

Also mounted within the body 70 is an upstanding tubular boss 98 which carries a vertically shiftable position pin 100, the latter of which has an enlarged head 102 in order to engage the upper end of the boss 98 and thereby limit the downward movement of the pin 100. By reference to FIG. 5, it can be observed that the lower end of the pin 100 will ride upon the upper surface of the roadway thus formed. In the event that a player has improperly matched any two of the planks, that is, so the irregular edges are not designed to be mated or matched, a space will exist therebetween. In this way, the position detecting pin 100 will, in effect, sense this space and fall through the space to engage one of the irregular edges of the plank which has been mismatched. It can be observed that the pin 100 will merely fall by means of its own weight, and, in this respect, is preferably formed of steel or a similar heavy metal.

As the pin 10 does fall into the space existing between two improperly matched planks, it will push the improperly matched plank, as well as planks subsequent thereto in the direction of movement of the vehicle, ahead of the vehicle and in the direction of movement of the vehicle. This pushing of the plank thereby causes a void or large opening in the roadway. At this point, the vehicle will fall through the roadway. The position detecting pin thereby creates a unique means to prevent any player from merely placing any particular plank on the roadway in order to complete assembly iof the roadway prior to the advancing vehicle.

The vehicle V is also provided with a vehicle element ejection mechanism 104 which is more fully illustrated in FIG. 6 of the drawings. In this case, the element 78 which is representative of a driver or passenger, as aforesaid, is formed of a vertically disposed plate 110 having an enlarged head portion 112 thereon and which is indicative of a human passenger or rider in this embodiment of the invention. Moreover, the plate 110 integrally merges into or is otherwise provided with a depending tab 114, the latter of which is provided with a locking slot 116 and a camming face 118 leading into the locking slot 116.

The vehicle V is provided with a plunger 120 having a plunger head 122 at the forward end of the plunger 120. At its rearward end, the plunger 120 is provided with an upwardly struck section 124 which integrally merges into a forwardly struck locking finger 126. Moreover, the locking finger 126 is provided with a camming face 128 for reasons which will presently more fully appear. By further reference to FIG. 6, it can be observed that the locking finger 126 will extend into the locking recess 116. In this respect, the seat 76 is provided with an opening 130 so that the downwardly struck tab 114 will extend into the interior of the body 70 in the manner as illustrated in FIGS. 3 and 6.

The plunger 120 is biased forwardly by means of a compression spring 132 which engages the upwardly struck section 124 and is retained by means of a downwardly struck retaining flange 134 formed within the vehicle. Moreover, a spring 136 is mounted within the body 70 and engages the underside of the tab 114. In this way, if a player attempts to impede the movement of the vehicle in an attempt to complete assembly of the roadway, the plunger 120 will be pushed rearwardly against the action of the compression spring 132. As this occurs, the locking finger 126 will be removed from the locking recess 116. The torque spring 136 will thereupon eject the element 78 from the vehicle to provide an indication that the player has improperly interfered with the movement of the vehicle V.

After the release of the plunger 120, the compression spring 132 will bias the plunger rod 120 forward. In this way, the element 78 can be reinserted into the vehicle with the tab 114 extending through the aperture 130. As this occurs, the camming face 126 on the tab 114 will force the locking finger, and hence the plunger rod 120, rearwardly against the action of the compression spring 132 until the element 78 has been fully seated. At this point, the locking finger 126 will thereupon extend back into the locking recess 116.

Thus, there has been illustrated and described a unique and novel action skill game in which a player must assemble planks on rails at a speed sufficient to prevent interruption of a movable object moving across the planks, and which therefore fulfills all of the objects and advantages sought therefor. It should be understood that many changes, modifications, variations and other uses and applications of the action skill game will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described our invention, what we desire to claim and secure by letters patent is:

1. A skill game comprising:

(a) support means having a starting end and including a pair of spaced apart generally parallel rails, extending generally longitudinally from said starting end, (b) a plurality of planks sized to be positioned generally transversely on said spaced apart rails to form an object supporting surface extending longitudinally from said starting end, said planks having irregular edges where they are to be placed in relationship to a next adjacent plank, each irregular edge on each plank conforming to the irregular edge of at least no more than a few of said plurality of planks but which is capable of conforming to an irregular edge of at least one plank so that said planks may be placed in successive adjacent conforming relationships to form a generally continuous extension of said supporting surface, and (c) a movable object capable of being propelled longitudinally across said object supporting surface at a speed such that the player of the game must attempt to lay the planks in conforming adjacent relationship starting from said starting end and before travel of the movable object is interrupted.

2. The game of claim 1 further characterized in that said plurality of rails comprises a pair of rails and a pair of spaced apart upstanding supports holding said rails in upwardly spaced relation from an area therebeneath.

3. The game of claim 2 further characterized in that an action element is located at said second upstanding support and is movable to indicate a score in the game if the vehicle reaches the second support across a completed supporting surface.

4. The game of claim 3 further characterized in that said action element also cooperates to stop movement of said vehicle.

5. The game of claim 1 further characterized in that said object is self propelled and provided with starter means to initiate movement of said object.

6. The game of claim 5 further characterized in that said object is a movable toy vehicle.

7. The game of claim 5 further characterized in that said movable object is provided with intercept means to cause an action to occur if the object is intercepted.

8. The game of claim 7 further characterized in that said object is a toy vehicle provided with a removable member therein and said intercept means comprises an element on said vehicle which ejects said member upon contact of said element.

9. The game of claim 5 further characterized in that said object is a toy vehicle provided with a removable member therein, said movable object is provided with intercept means to cause an action to occur if the object is intercepted, said intercept means comprises an element on said vehicle which ejects said member upon contact of said element, and said vehicle comprises sensing means to determine if one plank has been improperly conformed with an adjacent plank on said rails.

10. The game of claim 1 further characterized in that each of said planks can be oriented in either of two positions.

11. The game of claim 1 further characterized in the each of said planks can be oriented in any of four positions.

12. The game of claim 1 further characterized in that said object comprises sensing means to determine if one plank has been improperly conformed with an adjacent plank on said rails.

13. The game of claim 1 further characterized in that said planks have edges with portions thereof which are positioned in abutting relationship.

14. A skill action toy game comprising:

(a) support means having a starting end and including a pair of spaced apart generally parallel rails, (b) a plurality of planks sized to be positioned generally transversely on said rails to form a generally continuous object supporting surface, said planks being orientable in at least one position to be properly placed in adjacent relationship to the next plank on said rails to form said generally continuous upper object supporting surface on said planks, and (c) a movable object capable of being propelled longitudinally across said supporting surface at a speed such that the player of the game must attempt to lay the planks on the rails in the desired orientable position from the starting end before travel of the movable object is interrupted.

15. The game of claim 14 further characterized in that said support means comprises a pair of longitudinally spaced apart upstanding supports and said pair of rails extend between said supports and are suppoted in upwardly spaced relation from an area beneath said rails.

16. The game of claim 15 further characterized in tht each of said planks can be oriented in either of two positions.

17. The game of claim 15 further characterized in that each of said planks can be oriented in any of four positions.

18. The game of claim 15 further characterized in that each of said planks have an irregular edge where they are engageable with a next adjacent plank, each irregular edge on each plank mating with the irregular edge of at least no more than a few of said planks, but which is capable of matching an irregular edge of at least one plank.

19. The game of claim 14 further characterized in that the number of planks placed on the rails determines the score of a player.

20. A toy action skill game comprising:

(a) a bridge structure having a pair of spaced apart rails, (b) a plurality of planks with each having a size to be extended across said rails and each of said planks being encoded in a manner that the planks are to be placed on the rails in a proper relationship according to the encoding thereof to form a generally continuous upper surface representing a roadway on said bridge structure for supporting a movable object, (c) a movable object capable of being moved across said roadway and being started from a beginning end of said roadway so that the player of the game may attempt to assemble the planks on the rails to the end thereof in advance of the moving object.

21. The skill game of claim 20 further characterized in that said object is self-propelled and provided with starter means to initiate movement of said object.

22. The skill game of claim 21 further characterized in that said object is a movable toy vehicle.

23. The skill game of claim 20 further characterized in that each of said planks have an irregular edge where they are engageable with a next adjacent plank, each irregular edge on each plank mating with the irregular edge of at least no more than a few of said planks, but which is capable of matching an irregular edge of at least one plank.

24. The skill game of claim 23 further characterized in that each of said planks can be oriented in either of two positions.

25. The skill of claim 23 further characterized in that each of said planks can be oriented in any of four positions.

26. The skill game of claim 25 further characterized in that said object is a toy vehicle provided with a removable member theein and said intercept means comprises an element on said vehicle which ejects said member upon contact of said element.

27. The skill game of claim 20 further characterized in that said movable object is provided with intercept means to cause an action to occur if the object is intercepted.

28. The skill game of claim 27 further characterized in that said object comprises sensing means to determine if one plank has been improperly matched with an adjacent plank on said rails.

29. The game of claim 27 further characterized in that each of said planks have irregular edges so that no more than a few of the planks can be mated with any of the other planks.

30. A toy game of skill comprising:

(a) a plurality of rails, (b) a plurality of planks to be assembled on the rails to form a roadway for a vehicle and each of said planks being encoded in a manner that the planks are to be placed on said rails in a proper relationship according to the encoding thereof, and (c) a self-propelled vehicle for movement on said roadway with the player attempting to form the roadway in advance of the moving vehicle, said vehicle having sensing means to detect a mismatching of any of the planks on the rails.

31. The game of claim 30 further characterized in that said sensing means comprises a pin in said vehicle which moves along said roadway to detect spaces between said planks which are mismatched.

32. The game of claim 31 further characterized in that said vehicle includes a removable member representative of a driver or passenger of the vehicle, and intercept means on said vehicle which causes ejection of said removable member if movement of the vehicle is intercepted on the roadway.

33. The game of claim 32 further characterized in that said intercept means comprises a shiftable player on said vehicle, a locking means holding said member in said vehicle and said locking means being released when said plunger is shifted, and means biasing said member outwardly of said vehicle to eject said member when said locking means is released.

34. A method of playing a game of skill comprising:

(a) starting forward movement of an object along a roadway which is to be extended forwardly, (b) selecting one of a plurality of planks to be placed generally transversely across a pair of spaced apart rails, which extend forwardly in alignment with the roadway, said planks having one or more spaced apart edges designed to mate with edges of adjacently positioned planks, the selection being of a plank having an edge that will mate with the then forwardmost edge of the roadway, (c) positioning the selected plank on the rails in mating relationship to that forwardmost edge, whereby said plank forms a forward extension of said roadway, said selection and positioning being attempted at a fast enough rate to extend the roadway before the moving object can be beyond said forwardmost end, and (d) repeating steps (b) and (c) until a determined goal is achieved or the object does go beyond said forwardmost end.

35. The method of claim 34 further characterized in that said method comprises orienting said planks in four possible positions to determine if one plank will mate with a plank on the rails.

36. The method of claim 34 further characterized in that said object is self-propelled and provided with starter means to initiate movement of said object.

37. the method of claim 34 further characterized in that the number of planks on the rails determines the score of a player.

* * * * *